United States Patent [19]

Chenera

[11] Patent Number: 4,650,187

[45] Date of Patent: Mar. 17, 1987

[54] ACCESSORIES FOR AN EXERCISE ASSEMBLY

[76] Inventor: Robert Chenera, 140 Walton Ave., Union, N.J. 07083

[21] Appl. No.: 757,894

[22] Filed: Jul. 23, 1985

Related U.S. Application Data

[63] Continuation-in-part of Ser. No. 476,766, Mar. 18, 1983, Pat. No. 4,531,730.

[51] Int. Cl.[4] ..... A63B 23/02

[52] U.S. Cl. ..... 272/145; 272/93; 24/327

[58] Field of Search ..... 272/145, 93, 117, 134; 211/70.5; 24/327; 248/231.5, 316.5

[56] References Cited

U.S. PATENT DOCUMENTS

| | | | |
|---|---|---|---|
| 2,042,086 | 5/1936 | Aubert | 211/70.5 X |
| 3,203,421 | 8/1965 | Bialick | 24/327 X |
| 3,848,838 | 11/1974 | Thomas | 248/231.6 X |
| 4,116,434 | 9/1978 | Bernstein | 272/93 |
| 4,319,747 | 3/1982 | Rogers | 272/134 X |
| 4,419,989 | 12/1983 | Herbold | 272/145 X |
| 4,468,022 | 8/1984 | Wu | 272/93 |

*Primary Examiner*—Richard J. Apley
*Assistant Examiner*—John L. Welsh
*Attorney, Agent, or Firm*—Louis E. Marn

[57] ABSTRACT

There is disclosed an attachment assembly for mounting to a platform member to permit engagement by feet of the user for effecting other exercise protocols, e.g. sit-up exercises by the user.

7 Claims, 7 Drawing Figures

ACCESSORIES FOR AN EXERCISE ASSEMBLY

This is a continuation-in-part application of U.S. Ser. No. 06/476,766, filed Mar. 18, 1983, now U.S. Pat. No. 4,531,730.

BACKGROUND OF THE INVENTION (a) Field of the Invention

This invention relates to an exercise assembly, and more particularly to accessories for an excercise assembly.

(b) Description of the Prior Art

In the aforementioned co-pending application, incorporated herein by reference, there is described a novel exercise assembly comprised of a base support assembly on which is mounted a body support platform assembly including laterally extending platform members wherein the body support platform assembly may be readily raised and lowered with respect to the base support assembly thereby changing the relative angle between the platform members with respect to the horizontal. Such exercise assembly permitted development of leg flexibility, particularly for leg movements in the martial arts.

OBJECTS OF THE INVENTION

An object of the present invention is to provide accessories for such an exercise assembly to permit additional exercise usages.

Another object of the present invention is to provide an accessory for such an exercise assembly to still further improve leg flexibility of the user.

SUMMARY OF THE INVENTION

These and other objects of the present invention are achieved in one embodiment thereof by providing intermediate leg support member for a platform member for the body support assembly of the exercise assembly as described in the aforementioned co-pending U.S. Application Ser. No. 06/476,766. In another embodiment of the present invention there is provided an attachment assembly for mounting to the platform member to permit engagement by feet of the user for effecting other exercise protocols, e.g. sit-up exercises by the user.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein.

DETAILED DESCRIPTION OF THE DRAWINGS

Figure 1:
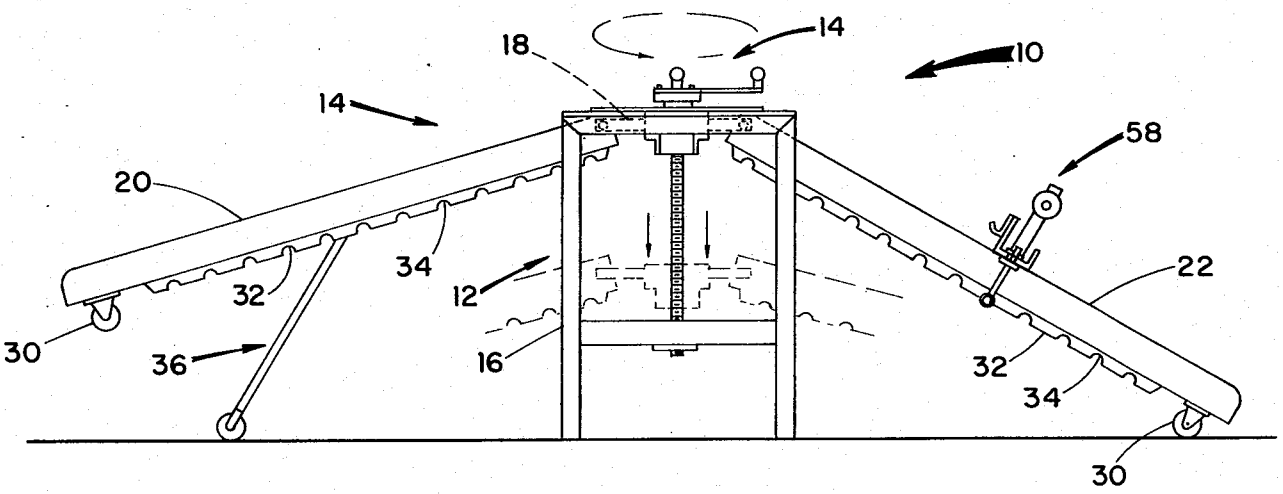
FIG. 1 is a somewhat schematic view of the exercise assembly including the accessory embodiments of the present invention.
Figure 2:
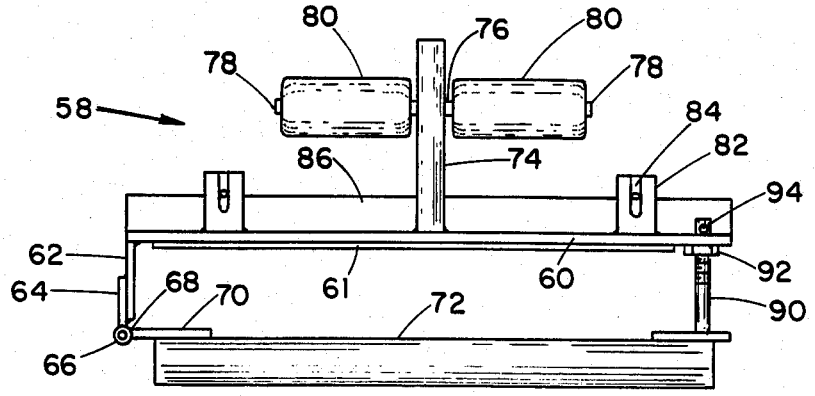
FIG. 2 is an elevational view of an attachment assembly mounted to a platform member.

Referring now to the drawings, and particularly FIG. 1, there is illustrated an exercise assembly, generally indicated as 10, comprised of a base support assembly and a body support platform assembly, generally indicated as 12 and 14, respectively, with the body support platform assembly 14 being transversely mounted with respect to the major axis of the base support assembly 12. The base support assembly 12 is comprised of side frame members 16, spatially mounted in parallel relationship to another by upper and lower beam members (not shown). As hereinabove mentioned, the description of the copending Application Ser. No. 06/476,766 filed Mar. 18, 1983 is incorporated herein for detailed disclosure of the details of construction and operation of the exercise assembly 10.

The body support platform assembly 14 is comprised of a center support member 18 from which are hingeably mounted outwardly extending right and left side platform members 20 and 22, respectively. The side platform members 20 and 22 are formed of rectangularly-shaped panels 24 including a foam portion 26 overlayed by a vinyl covering 28, referring also to FIGS. 5 and 6. At an end position on the underside portion of each panel 24 of the right and left side platform members 20 and 22 there are mounted roller members 30. The underside portion of the side platforms 20 and 22 are provided with strengthening bar elements 32 including a plurality of notches 34 for receiving an attachment accessory for use in other exercise routines, such as Roman sit-ups, etc., as more fully hereinafter disclosed.

Figure 5:
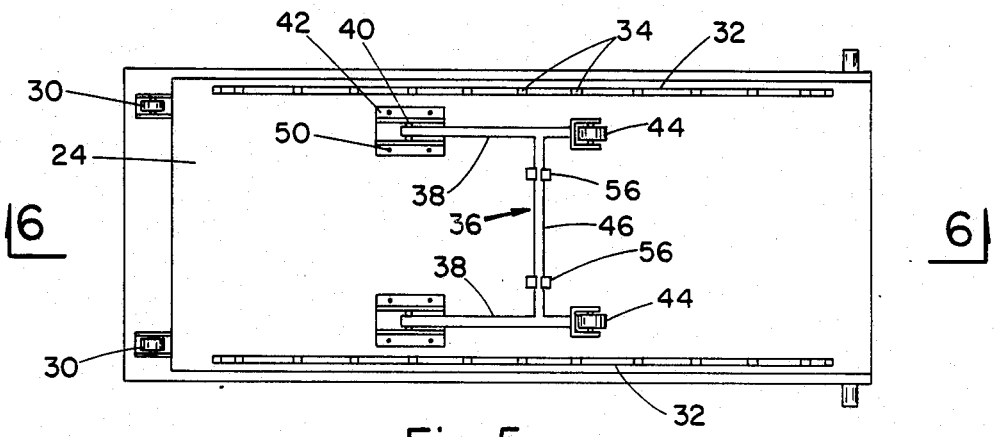
FIG. 5 is a bottom view of a platform member including intermediate leg support member.
Figure 6:
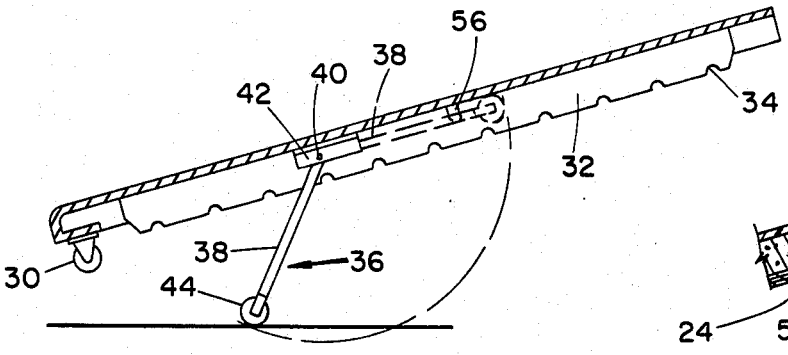
FIG. 6 is a side view of the platform member with the intermediate leg support member disposed in an extended position.
Figure 7:
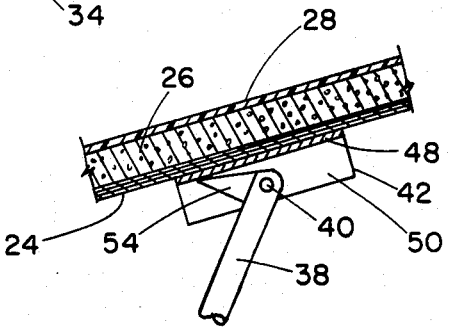
FIG. 7 is an enlarged partial side view of a hinging arrangement for the intermediate leg support member.

One or both of the side platform members 20 and 22 is provided with an intermediate leg support assembly, generally indicated as 36, referring particularly to FIGS. 5 and 6, comprised of paired leg elements 38 hingeably mounted by hinge member 40 to parallelly-disposed hinge support member 42 mounted, such as by threaded wood screws (not shown), to the underside portion of the panel 24. Each leg element 38 is provided with a roller 44 mounted for rotation at a distal portion thereof from the hinge support members 42. The leg elements 38 are mounted to one another, such as by welding, by an intermediate bar member 46.

Each hinge support member 42 is comprised of a flat base plate 48 and parallely-disposed plate members 50 perpendicularly mounted to the base plate 48 forming a channel for receiving an end of the leg element 38 and hinge member 40 for hingeable rotation thereon. Each leg element 38 is provided with a triangularly-shaped member 54 mounted thereto proximate the hinge support member 42 for contacting the base plate 48 thereof to thereby establish a predetermined angular relationship between the side platform member 20 and the intermediate leg support assembly 36 in an extended position of the intermediate leg support assembly 36. U-shaped clamp elements 56 are mounted to the panel 24 to engage the bar member 46 of the intermediate leg support assembly 36 in a stored position substantially in parallel relationship to the panel 24.

The attachment assembly, generally indicated as 58, referring particularly to FIGS. 1 to 4, is comprised of an upper plate member 60 including a lower padding 61 perpendicularly mounted to a side member 62 having one leg element 64 of a hinge 66 including hinge pin 68 mounted thereto with the other leg element 70 of the hinge 66 mounted to a tubularly-shaped member 72 for transverse mounting to a side platform member, such as side platform member 22, as more fully hereinafter described.

To the upper plate member 60 there is mounted a post member 74 positioned proximate a midpoint thereto and perpendicularly-disposed to a plane of the plate member 60. A bar member 76, spaced apart from the plate member 60, is mounted to the post member 74 in parallel relationship to the plate member 60 and extending outwardly from either side of the post member 74 thereby forming arm portions 78 thereof. Cylindrically-shaped cushion members 80 are mounted on the arm portions 78 of the bar member 76.

Figure 3:
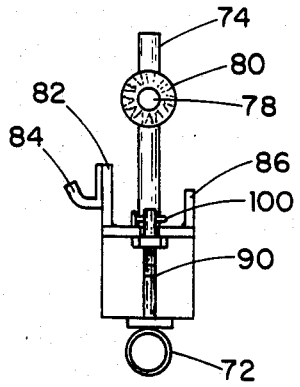
FIG. 3 is a side view of the attachment assembly.

To a forward portion of the plate member 60, referring particularly to FIG. 3, there are mounted holding members 82 including a J-shaped bar element 84 for receiving and positioning a barbell (not shown). To a rearward portion of the plate member 60 there is mounted an upright bar member 86 perpendicularly-disposed to the plate member 60 along a longitudinal axis thereof.

Figure 4:
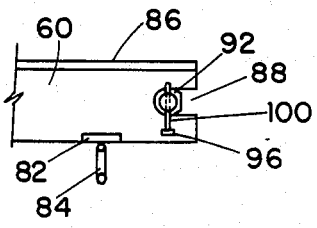
FIG. 4 is a partial top view of the attachment assembly.

In the plate member 60 there is formed a slot 88, referring particularly to FIG. 4, at an end of the plate member 60 opposite the end to which the plate member 60 is mounted to the side member 62. To an end of tubularly-shaped member 72 opposite the end mounted to the leg element 70 of the hinge member 66, there is mounted a threaded rod member 90 perpendicularly-disposed to the plane of the tubularly-shaped member 72 and of a length sufficient to extend upwardly through the slot 88 and beyond the plane of the plate member 60 when the element 72 is disposed in parallel relationship to the plate member 60. The threaded rod member 90 is provided with a positioning bolt member 92 and is formed with an opening 94 in an end portion thereof above the plate member 60 upon positioning of the rod member 90 within the slot 88. A pin member 96 including a head portion 98 and a shank portion 100 is provided to lock the attachment assembly 58 onto a platform assembly of the body support 14 by fixedly positioning the shank 100 of the pin member 96 in the opening 94 of the rod member 90 with the head portion 98 of the pin member 96 contacting a side of the bar member 60.

In operation, as discussed in the co-pending application, a user interested in improving leg flexibility mounts the exercise assembly 10 to assume a straddled position. Once straddling the exercise assembly 10, the user may readily lower and raise body support platform assembly 14 aided by the rollers 30 to increase or decrease, respectively, the angle between the side platforms 20 and 22 and the horizontal. The maximum angle between the side platforms 20 and 22 is determined by the lowest position of the center support member 18 to the base support assembly 14 and the length of the side platforms 20 and 22. Use of the intermediate leg support assembly 36 permits a further increase of the angle between the side platforms 20 and 22 and the horizontal.

The attachment assembly 58 may be positioned at any desired spaced apart intervals along a side platform corresponding to notches 34 formed in the strengthening bar elements 32. To position the attachment assembly 58 on the side platform 22, the tubularly-shaped member 72 is moved in a clockwise direction about the hinge member 66 thereby opening the attachment assembly 58 to permit placement about the side platform 22 at a preselect position thereof corresponding to paired notches 34, e.g. as illustrated in FIG. 1. Thereafter the tubularly-shaped member 72 is rotated in a counterclockwise direction about the hinge member 66 to a point where the threaded rod member 90 enters the slot 88 formed in the bar member 76 with the bolt 92 facilitating spatial placement. Thereafter the shank 100 of the pin member 96 is inserted into the opening 94 to thereby lock the tubularly-shaped member 72 with respect to the upper plate member 60.

In use, a user positions either or both feet under the cushion members 80, as illustrated in FIG. 3, with the upright bar member 86 as a heel rest. By such positioning of the user's foot with the body of the user extending upwardly towards the center of the exercise assembly 10, the user may readily perform sit-up and preacher bench type exercises. A barbell including weights (not shown) may be positioned within the J-shaped bar elements 84 for preacher bench usage. A barbell may be disposed in the tubularly-shaped member 72 with weights subsequently disposed on the ends of such barbell to ensure stability if needed.

While the invention has been described in connection with an exemplary embodiment thereof, it will be understood that many modifications will be apparent to those of ordinary skill in the art, and that this application is intended to cover any adaptations or variations thereof. Therefore, it is manifestly intended that this invention be only limited by the claims and the equivalents thereof.

What is claimed:

1. A combination of an exercise assembly including a laterally-extending side platform having parallelly-disposed positioning members including spaced apart slots disposed longitudinally along said side platform; and an accessory therefor, comprised of an upper plate member; a support means mounted to said upper plate member for receiving a foot portion of a user of said accessory; a lower retaining member hingeably mounted to said upper plate member; and means for securing said lower retaining member to said upper plate member to retain said accessory at a preselect position on said side platform.

2. The accessory as defined in claim 1 wherein said support means includes paired cylindrically-shaped members transverselydisposed with respect to said side platform.

3. The accessory as defined in claim 2 wherein said cylindrically-shaped members are provided with a cushion member.

4. The accessory as defined in claim 1 wherein said lower retaining member is shaped to correspond to the shape of said slots of said positioning members.

5. The accessory as defined in claim 4 wherein said lower retaining member is tubularly-shaped to receive a bar of a barbell assembly.

6. The accessory as defined in claim 1 wherein said plate member includes a slot and wherein said securing means includes a rod member mounted to said lower retaining member extending upwardly through said slot in a retained position of said accessory about said side platform.

7. The accessory as defined in claim 6 wherein said rod member includes a channel formed in an end thereof to receive a shaft of a pin member to lock said accessory in said retained position.

* * * * *